US007352375B2

(12) United States Patent
Yamazaki et al.

(10) Patent No.: US 7,352,375 B2
(45) Date of Patent: Apr. 1, 2008

(54) DRIVING METHOD OF LIGHT EMITTING DEVICE

(75) Inventors: Shunpei Yamazaki, Tokyo (JP); Kazutaka Inukai, Kanagawa (JP); Yasuko Watanabe, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 336 days.

(21) Appl. No.: 10/428,002

(22) Filed: May 2, 2003

(65) Prior Publication Data

US 2005/0259089 A1 Nov. 24, 2005

(30) Foreign Application Priority Data

May 16, 2002 (JP) ..... 2002-142113

(51) Int. Cl.
*G09G 5/10* (2006.01)

(52) U.S. Cl. ..... 345/691; 345/596

(58) Field of Classification Search ..... 345/596, 345/616, 690–693

See application file for complete search history.

(56) References Cited

U.S. PATENT DOCUMENTS 5,818,419 A * 10/1998 Tajima et al. ..... 345/691
6,069,609 A * 5/2000 Ishida et al. ..... 345/596
6,144,364 A 11/2000 Otobe et al.
6,157,356 A * 12/2000 Troutman ..... 345/82
6,417,835 B1 7/2002 Otobe et al.
6,456,301 B1 * 9/2002 Huang ..... 345/691
6,563,486 B2 5/2003 Otobe et al.
6,624,587 B2 * 9/2003 Kim ..... 315/169.1
6,646,625 B1 11/2003 Shigeta et al.
6,819,335 B2 * 11/2004 Naganuma ..... 345/692
6,936,846 B2 * 8/2005 Koyama et al. ..... 257/71
6,967,636 B2 11/2005 Shigeta et al.
7,042,424 B2 5/2006 Shigeta et al.
7,095,390 B2 8/2006 Otobe et al.
7,119,766 B2 10/2006 Otobe et al.

(Continued)

FOREIGN PATENT DOCUMENTS

EP 1 022 714 7/2000

(Continued)

OTHER PUBLICATIONS

Ogawa et al., "PDP Technology for High Picture Quality," FUJITSU. 49, 3, pp. 209-213, May 1998.

*Primary Examiner*—Kent Chang
(74) *Attorney, Agent, or Firm*—Eric J. Robinson; Robinson Intellectual Property Law Office, P.C.

(57) ABSTRACT

A method of driving a light emitting device in which a plurality of pixels having a light emitting element are formed, characterized by including: setting j display periods (where j is a natural number) to appear in one frame period, each of the j display periods corresponding to one bit of a k-bit digital video signal (where k is a natural number); and subjecting lower n bits of the k bits (where n is a natural number, $j \geqq k-n$) to one or both of dither processing and error diffusion processing to thereby select whether the pixels turn on or turn off in each of the j display periods according to a (k−n)-bit digital video signal that is converted from the k-bit digital video signal.

12 Claims, 11 Drawing Sheets

U.S. PATENT DOCUMENTS

| | | | | |
|---|---|---|---|---|
| 2002/0047852 | A1 | 4/2002 | Inukai et al. | |
| 2002/0054000 | A1 | 5/2002 | Tokunaga et al. | |
| 2002/0135312 | A1* | 9/2002 | Koyama | 315/169.3 |
| 2002/0135595 | A1 | 9/2002 | Morita et al. | |
| 2003/0025656 | A1 | 2/2003 | Kimura | |
| 2003/0132716 | A1* | 7/2003 | Yamazaki et al. | 315/169.3 |
| 2005/0078060 | A1 | 4/2005 | Shigeta et al. | |
| 2006/0279482 | A1 | 12/2006 | Otobe et al. | |

FOREIGN PATENT DOCUMENTS

| | | |
|---|---|---|
| JP | 08-179738 | 7/1996 |
| JP | 09-081072 | 3/1997 |
| JP | 09-212127 | 8/1997 |
| JP | 10-031455 | 2/1998 |
| JP | 10-312173 | 11/1998 |
| JP | 2000-227778 | 8/2000 |
| JP | 2000-276102 | 10/2000 |
| JP | 2001-056665 | 2/2001 |
| JP | 2002-082649 | 3/2002 |

* cited by examiner

[FIG. 1]
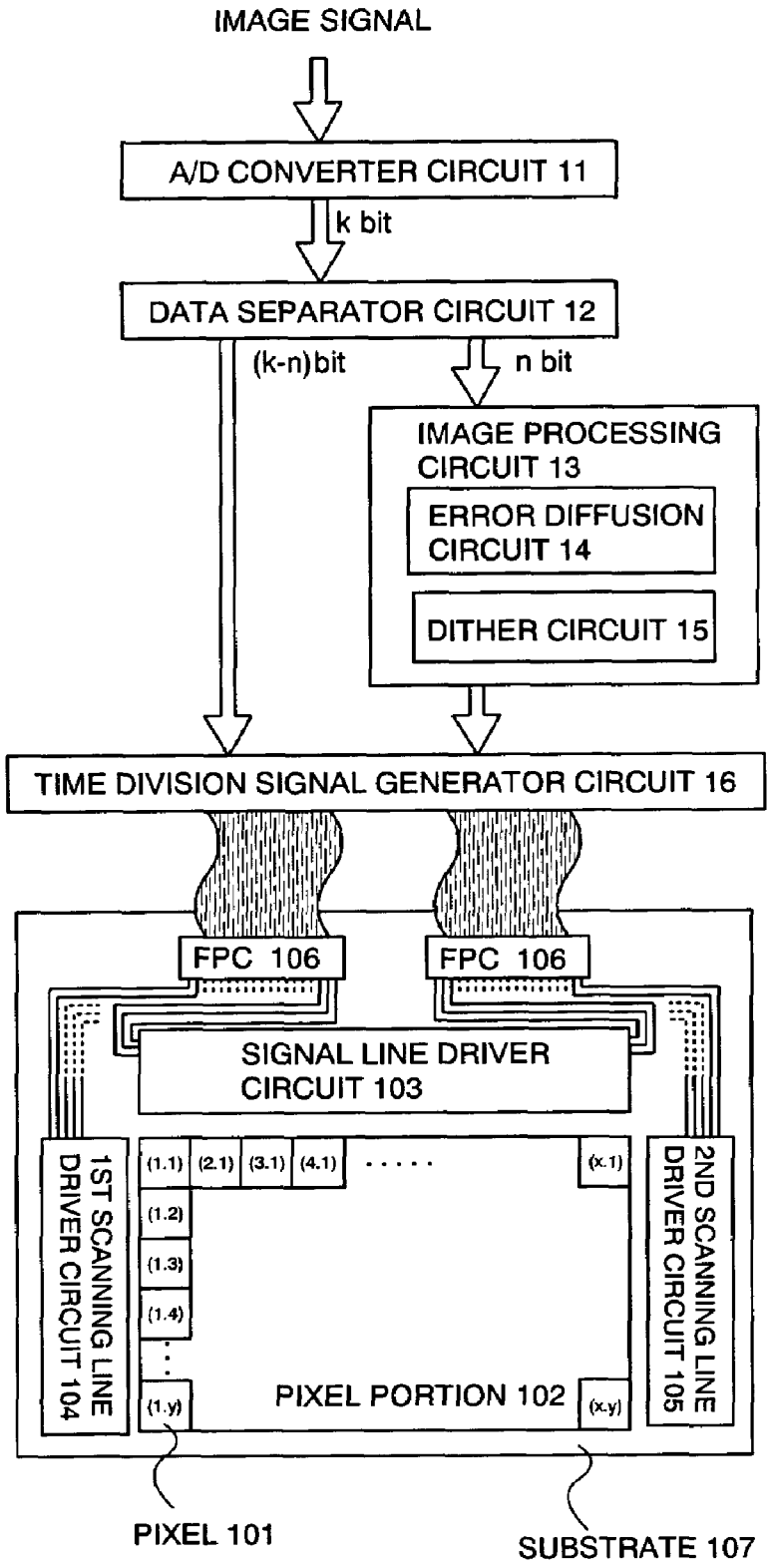

[FIG. 2]
(A)
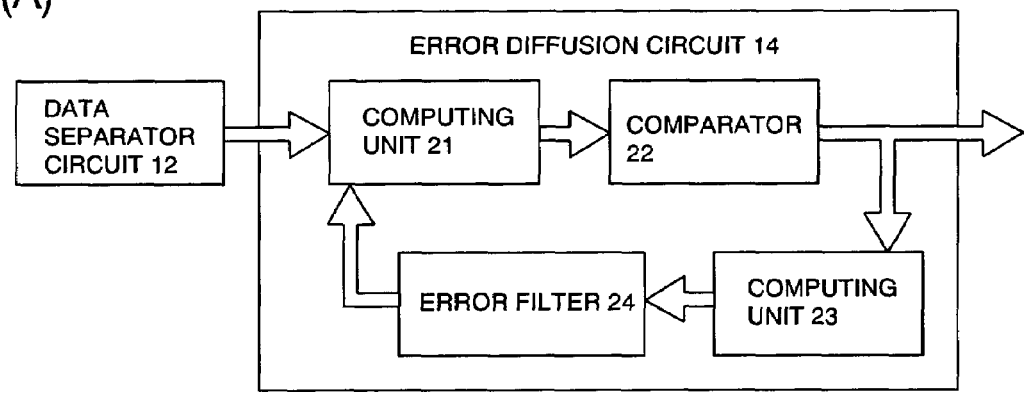
(B)
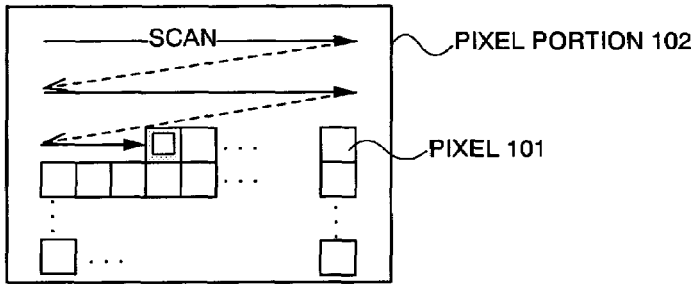
(C) FLOYD & STEINBERG
| | | |
|---|---|---|
| | (i,j) | 7/16 |
| 3/16 | 5/16 | 1/16 |
(D) JARVIS, JUDICE & NINKE
| | | | | |
|---|---|---|---|---|
| | | (i,j) | 7/48 | 5/48 |
| 3/48 | 5/48 | 7/48 | 5/48 | 3/48 |
| 1/48 | 3/48 | 5/48 | 3/48 | 1/48 |

[FIG. 3]
(A)
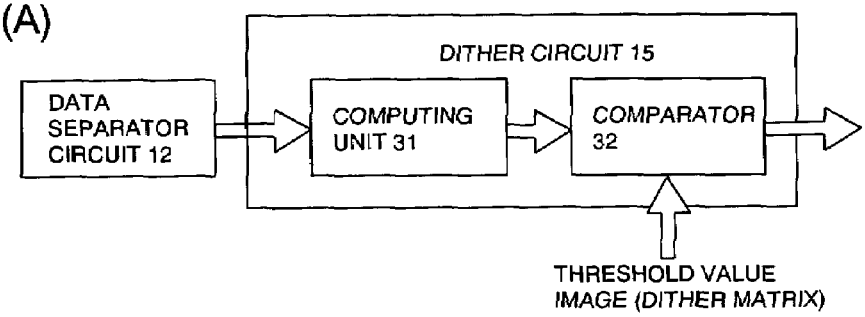
(B)
| | | | | |
|---|---|---|---|---|
| 22 | 14 | 10 | 21 | 25 |
| 18 | 6 | 2 | 9 | 17 |
| 11 | 3 | 1 | 5 | 13 |
| 15 | 7 | 4 | 8 | 20 |
| 23 | 19 | 12 | 16 | 24 |
(C) BAYER TYPE
| | | | |
|---|---|---|---|
| 0 | 8 | 2 | 10 |
| 12 | 4 | 14 | 6 |
| 3 | 11 | 1 | 9 |
| 15 | 7 | 13 | 5 |
(D) IMAGE DATA (E) DITHER MATRIX (BAYER TYPE) (F) OUTPUT
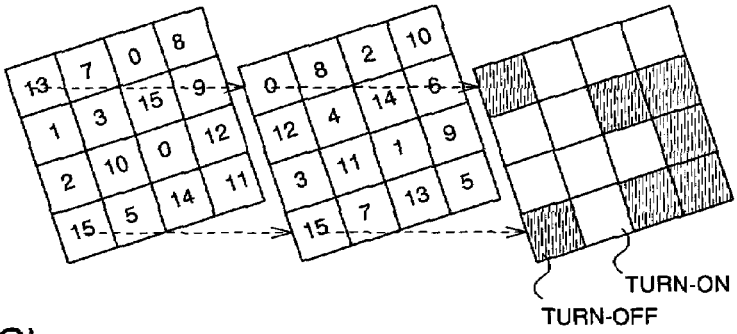
(G)
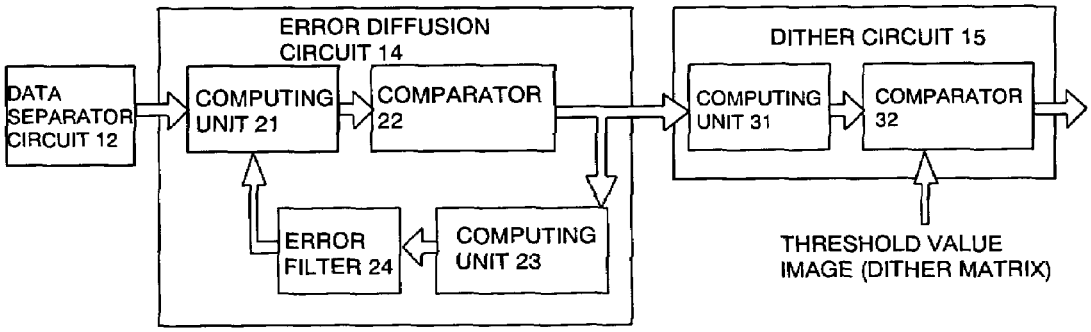

[FIG. 4]
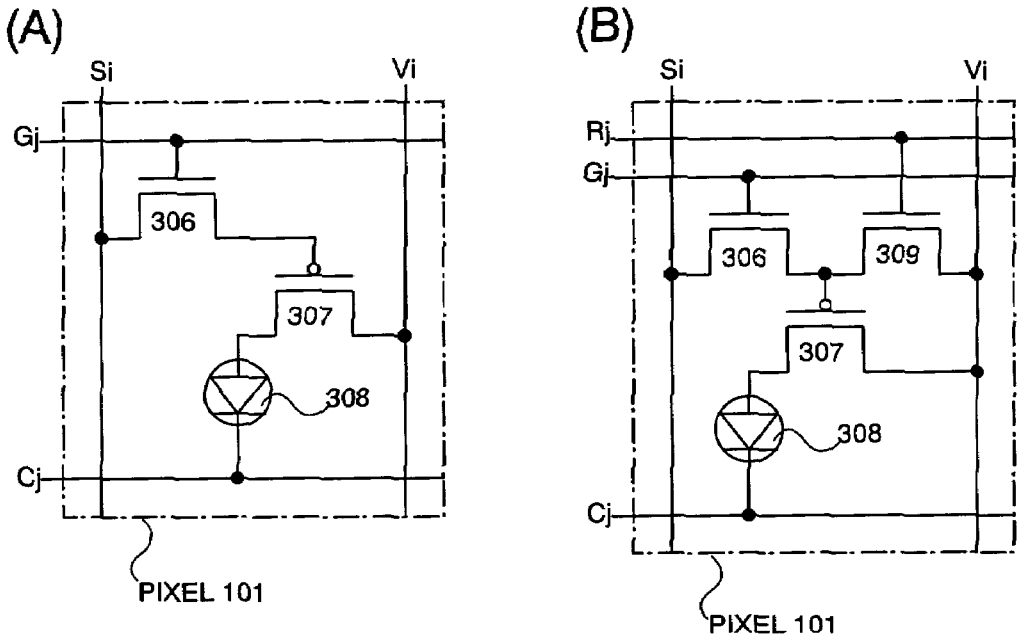

[FIG. 5]
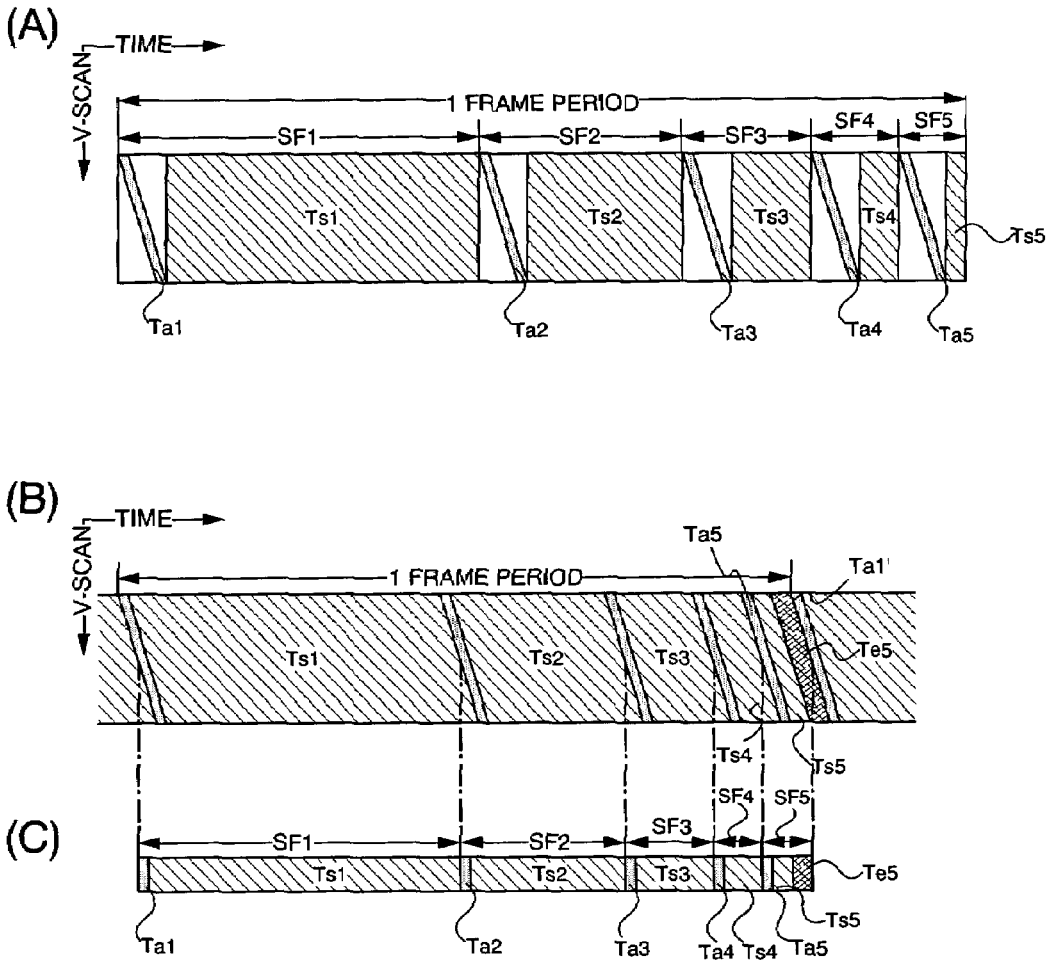

[FIG. 6]
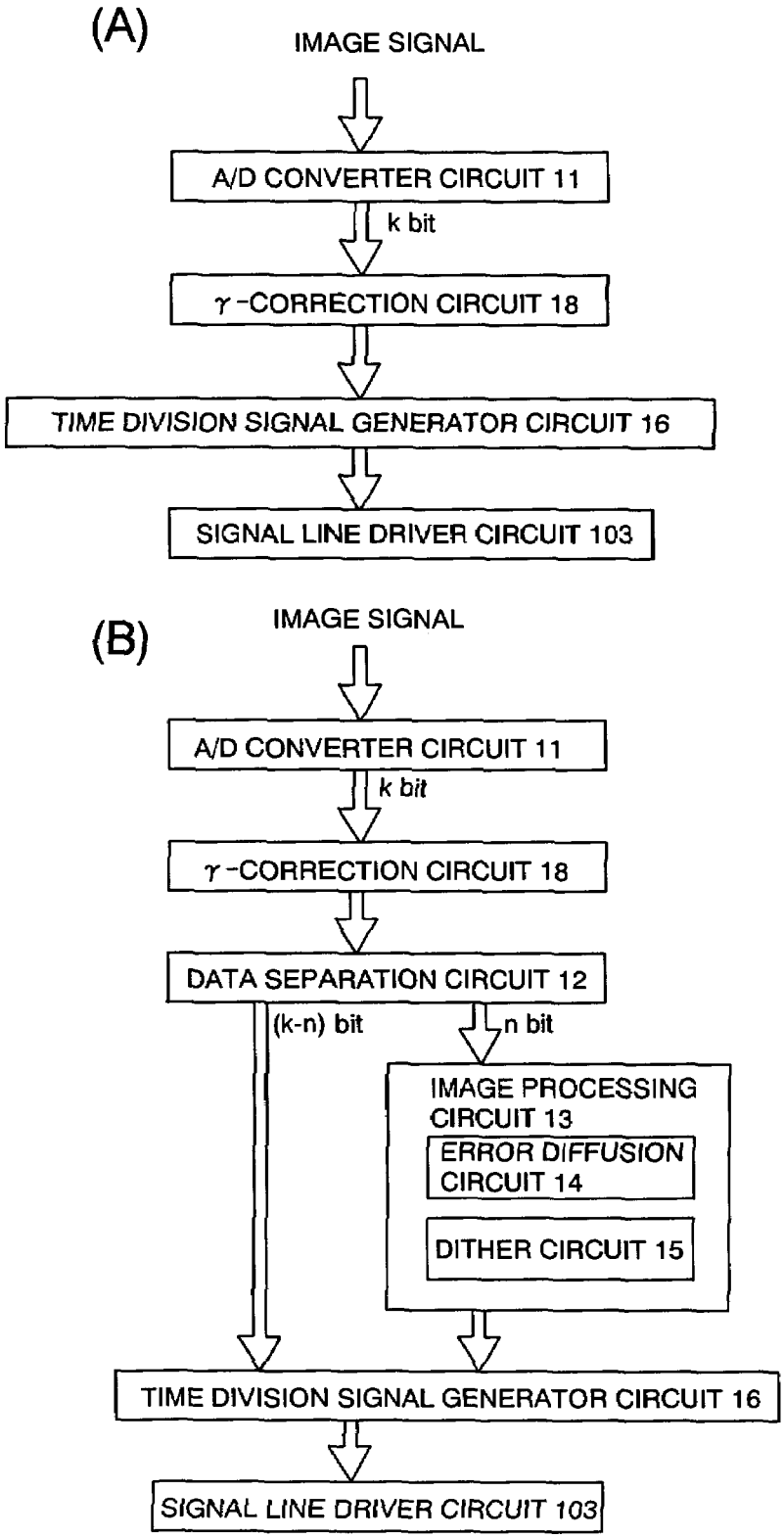

[FIG. 7]
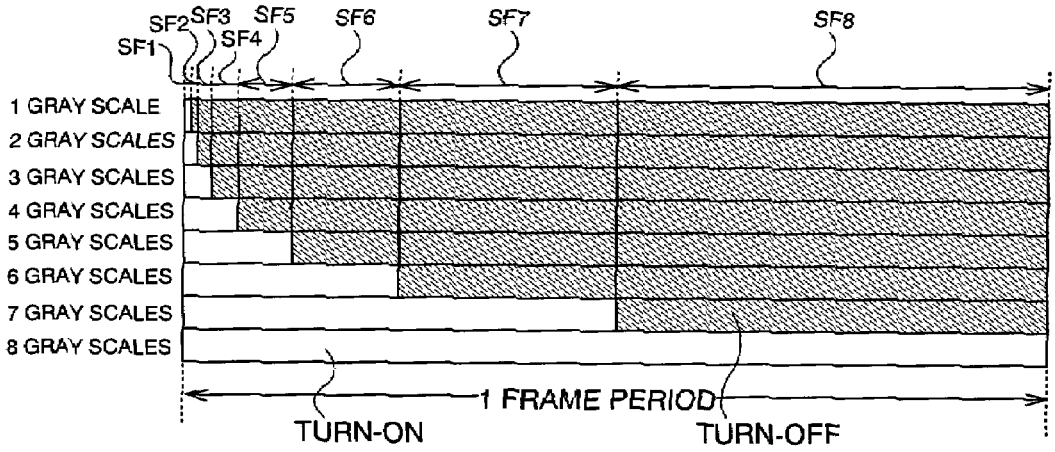

[FIG. 8]
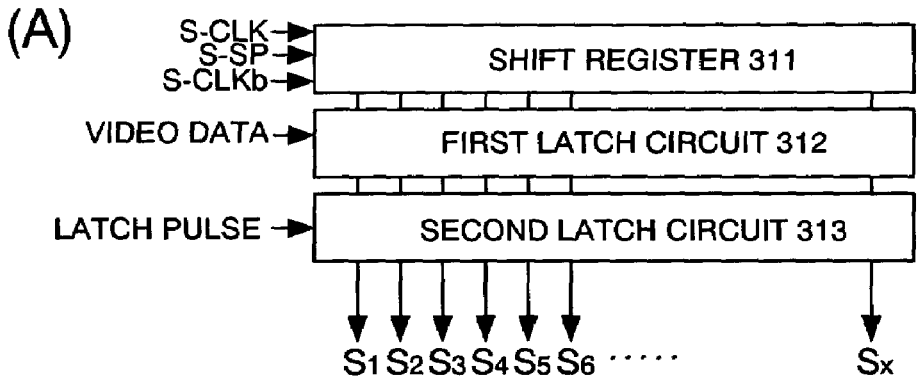
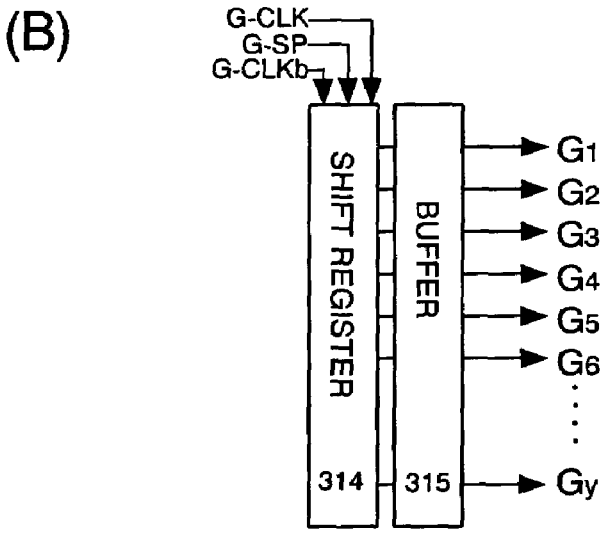

[FIG. 9]
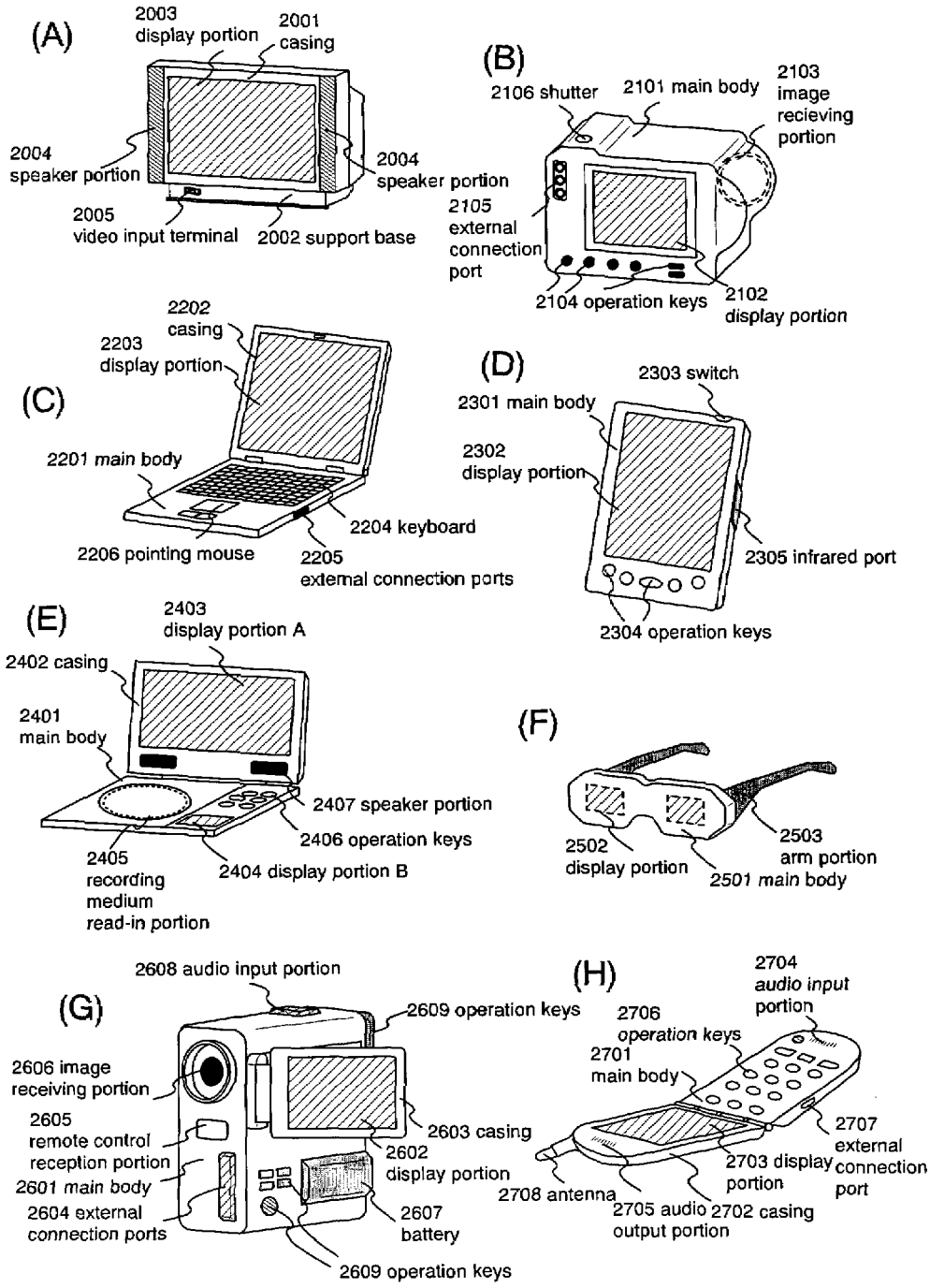

[FIG. 10]
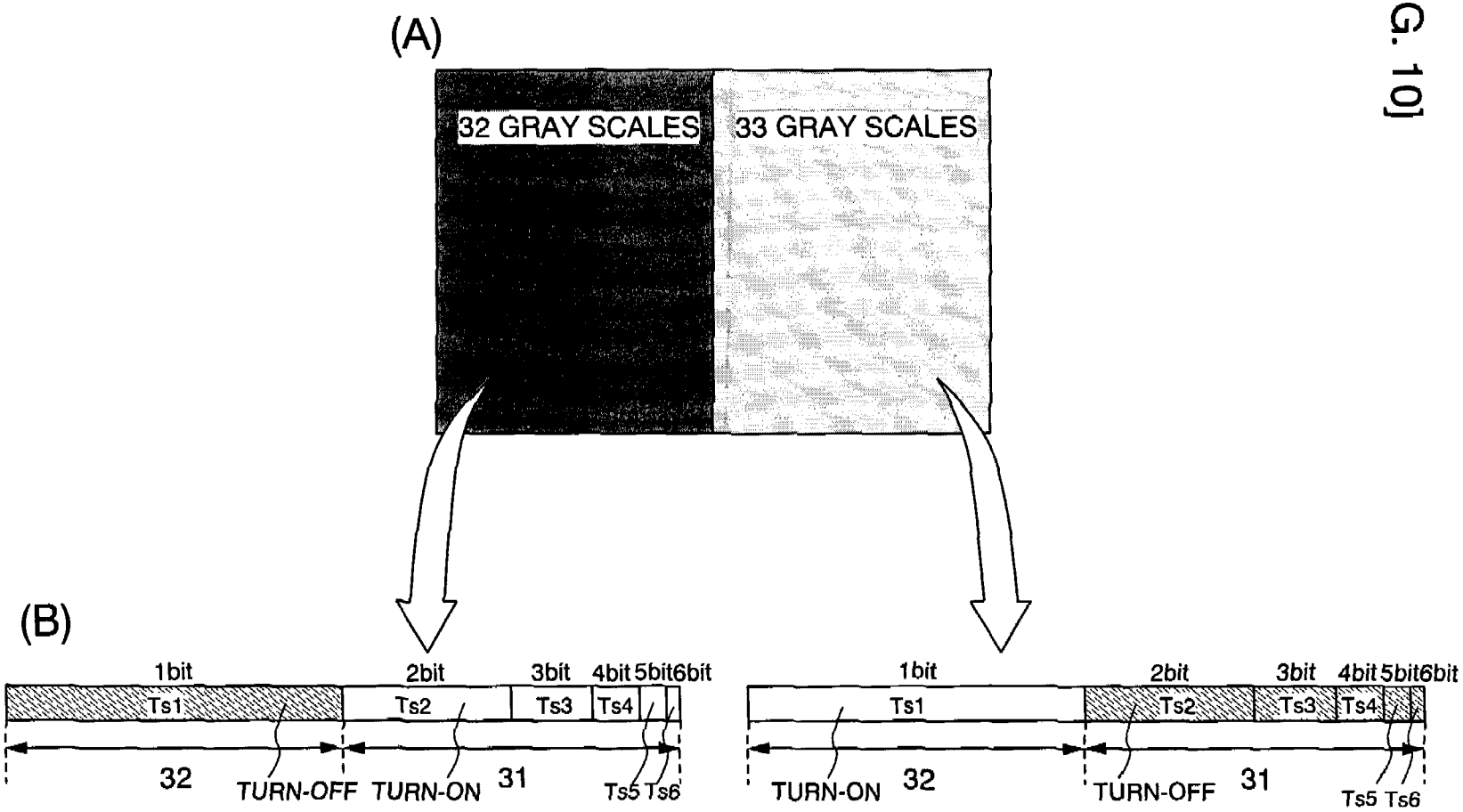

[FIG. 11]
(A)
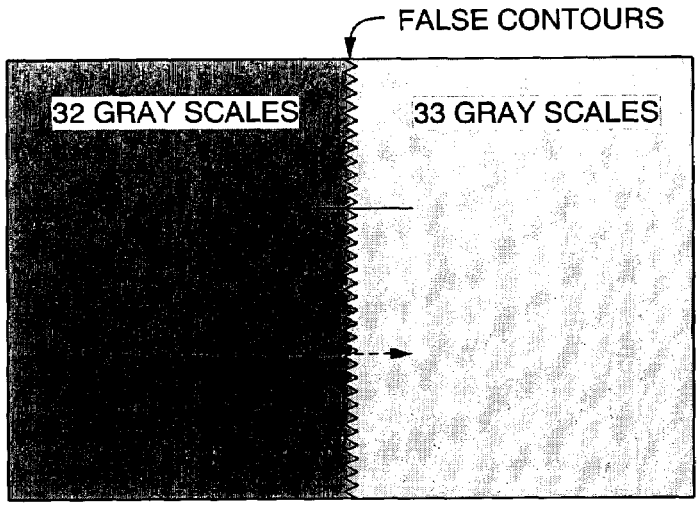
(B)
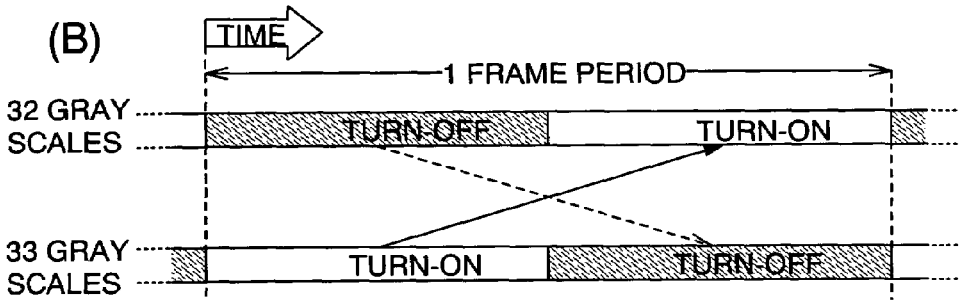

DRIVING METHOD OF LIGHT EMITTING DEVICE

BACKGROUND OF THE INVENTION

1. Field of the Invention

The present invention relates to a technology concerning a light emitting device having a light emitting element.

2. Description of Related Art

The introduction of digital technology into equipment and systems used in broadcasting has been progressing. Research and development is being performed in many countries toward achieving the digitalization of broadcast waves, that is, achieving digital broadcasting.

Further, in response to the digitization of broadcast waves, research and development of active matrix display devices capable of displaying an image using a digital video signal having image information (digital video signal) as it is, without converting the digital signal into an analog signal, has also been extensively progressing in recent years.

There are typically two driving methods available for performing gray scale display by using binary voltage signal of the digital video signal, including an area ratio gray scale scheme and a time gray scale method.

The area ratio gray scale scheme is a driving method that performs gray scale display by dividing one pixel into a plurality of sub-pixels, and independently driving each of the sub-pixels based on a digital video signal. One pixel must be divided into a plurality of sub-pixels with this area ratio gray scale scheme. In addition, in order that the divided sub-pixels are driven independently, it is necessary to form pixel electrodes corresponding to each of the sub-pixels. A problem develops in that the pixel structure becomes complex.

On the other hand, the time gray scale method is a driving method that performs gray scale display by controlling the length of turn-on of the pixels. Specifically, one frame period is divided into a plurality of display periods arranged on a time axis in a predetermined order (display periods). Each of the display periods is weighted to correspond with a gray scale level, and by turning on or turning off each pixel according to the digital video signal, gray scale display is performed. That is, the gray scale of a pixel can be found by integrating the lengths of the display periods within the one frame period during which the pixel turns on, from among all of the display periods that appear within the one frame period.

The development of light emitting devices using light emitting elements has been progressing in recent years. In addition to the advantages of currently existing liquid crystal display devices, the light emitting devices also have characteristics such as high response speed, superior dynamic display, and a wide field of view, and attract attention as next generation small size mobile flat panel displays capable of utilizing dynamic contents.

A wide variety of materials such as organic materials, inorganic materials, thin film materials, bulk materials, and dispersion materials are used for the light emitting elements. Among those, organic light emitting diodes (OLEDs) that are formed mainly of organic materials can be given as typical light emitting elements. The OLEDs have a structure with an anode, a cathode, and a light emitting layer that is sandwiched between the anode and the cathode. The light emitting layer is formed of one or a plurality of materials selected from the aforementioned materials. Further, luminescence in the light emitting layer includes light emission when returning to a base state from a singlet excitation state (fluorescence) and light emission when returning to a base state from a triplet excitation state (phosphorescence). The OLED response speed is generally high as compared with that of liquid crystals and the like, and therefore the time gray scale method is applied.

SUMMARY OF THE INVENTION

Problems to be Solved by the Invention

It is convenient to use a binary coding method (binary coding method) to achieve high gray scales for cases where the time gray scale method is employed. A case of displaying intermediate gray scales by the time gray scale method according to a simple binary coding method is explained in detail hereinafter using FIG. 10.

BRIEF DESCRIPTION OF THE DRAWINGS

[FIG. 1] A diagram showing a light emitting device.

[FIGS. 2A-2D] Diagrams showing an error diffusion circuit.

[FIGS. 3A-3G] Diagrams showing a dither circuit.

[FIGS. 4A-4B] Circuit diagrams of a pixel of a light emitting device.

[FIGS. 5A-5C] Timing charts.

[FIGS. 6A-6B] Diagrams showing a light emitting device.

[FIG. 7] A timing chart.

[FIGS. 8A-8B] Diagrams showing a structure of a driver circuit.

[FIGS. 9A-9H] Diagrams showing electronic devices to which the present invention is applied.

[FIGS. 10A-10B] Diagrams for explaining a mechanism by which false contours are generated.

[FIGS. 11A-11B] Diagrams for explaining a mechanism by which false contours are generated.

DETAILED DESCRIPTION OF THE INVENTION

FIG. 10(A) shows a pixel portion of a light emitting device, and FIG. 10(B) shows the lengths of all the display periods appearing within the one frame period (corresponding to sustaining periods for a PDP) in the pixel portion. An example of displaying an image by using a 6-bit digital video signal that is capable of displaying 1 to 64 gray scales is shown in FIG. 10. Using a right half portion of the pixel portion, 33 (32+1) gray scales are displayed, and using a left half portion of the pixel portion, 32 (31+1) gray scales are displayed.

Six display periods $Ts_1$ to $Ts_6$ generally appear for cases of using the 6-bit digital video signal. A first bit to a sixth bit of the digital video signal correspond to the display periods $Ts_1$ to $Ts_6$, respectively.

With the binary coding method, the length ratio of the display periods $Ts_1$ to $Ts_6$ is set as $2^5:2^4:2^3:2^2:2^1:2^0$ The length of the display period Ts that corresponds to the uppermost bit (the first bit in this case) of the digital video signal is the longest, and the length of the display period $Ts_6$ that corresponds to the lowermost bit (the sixth bit) of the digital video signal is the shortest.

The pixels are placed in a turned-on state in the display periods $Ts_1$ to $Ts_6$, and the pixels are placed in a turned-off state in the display period $Ts_1$, for a case of performing display of 32 gray scales. Further, the pixels are placed in a turned-off state in the display periods $Ts_2$ to $Ts_6$, and the pixels are placed in a turned on state in the display period $Ts_1$, for a case of performing display of 33 gray scales.

False contours may be viewed in the pixel portion at boundary portions between a portion that displays 32 gray scales and a portion that displays 33 gray scales when an image is displayed using this driving method.

False contours are unnatural contour lines that are frequently viewed when performing time gray scale display by the binary coding method. Fluctuations in perceived brightness that develop due to the characteristics of human vision are the main cause of false contouring. A mechanism by which false contours develop is explained using FIG. 11.

FIG. 11(A) shows a pixel portion of a light emitting device in which false contours seem to develop. FIG. 11(B) shows the ratio of the lengths of display periods appearing within one frame period in the pixel portion. An image is shown in FIG. 11 using a 6-bit digital video signal capable of displaying the 1 to 64 gray scales. The right half portion of the pixel portion displays 33 gray scales, and the left half portion displays 32 gray scales.

Pixels in the pixel portion that display 32 gray scales are in a turned-on state for a period that is $^{31}/_{63}$ of the one frame period, and are in a turned-off state for a period that is $^{32}/_{63}$ of the one frame period. The period during which the pixels are in a turned-on state and the period during which the pixels are in a turned-off state appear alternately.

Also, pixels in the pixel portion that display 33 gray scales are in a turned-on state for a period that is $^{32}/_{63}$ of the one frame period, and are in a turned-off state for a period that is $^{31}/_{63}$ of the one frame period. The period during which the pixels are in a turned-on state and the period during which the pixels are in a turned-off state appear alternately.

When displaying a dynamic image, it is assumed that the boundary between the portions that display 32 gray scales and the portions that display 33 gray scales moves in the direction of an arrow shown by the dashed line in FIG. 11(A), for example. That is, the pixels in the vicinity of the boundary switch between display of 32 gray scales and display of 33 gray scales. In the pixels in the vicinity of the boundary, a turn-on period starts in order to display 33 gray scales immediately after a turn-on period for displaying 32 gray scales. The pixels therefore seem to turn on continuously by the human eye during the one frame period. This is perceived as an unnatural bright line on a screen.

On the contrary, it is assumed that the boundary between the portions that display 32 gray scales and the portions that display 33 gray scales moves in the direction of an arrow shown by the solid line in FIG. 11(A), for example. That is, the pixels in the vicinity of the boundary switch between display of 33 gray scales and display of 32 gray scales. In the pixels in the vicinity of the boundary, a turn-on period starts in order to display 32 gray scales immediately after a turn-on period for displaying 33 gray scales. The pixels therefore seem to be turned on continuously during the one frame period by the human eye. This is perceived as an unnatural dark line on a screen.

The unnatural bright lines and the unnatural dark lines that thus seem to appear on the screen are display disturbances referred to as false contours (dynamic image false contours).

The display disturbances may also be viewed in still images as well, due to the same cause as that leading to dynamic image false contours developing in dynamic images. The display disturbances in still images are ones in which gray scale boundaries seem to fluctuate. A reason for this type of display disturbance being viewed in still images is discussed in brief hereinafter.

Even if the human eye attempts to stare at one point, its viewpoint will fluctuate slightly, and it is difficult to stare fixedly at one given point. Therefore, when the human eye stares at a boundary in the pixel portion between the portion that displays 32 gray scales and the portion that displays 33 gray scales, even if intending to stare fixedly at the boundary, in practice the viewpoint will move slightly left and right, up and down.

Assume that the viewpoint moves, for example, from the portion that performs display of 32 gray scales to the portion that performs display of 33 gray scales, as indicated by a dashed line. For a case where the viewpoint is at the portion that displays 32 gray scales when the pixels are in a turned-off state, and the viewpoint is placed at the portion that displays 33 gray scales when the pixels are in a turned-off state, the human eye perceives this as if the pixels are turned off continuously during the one frame period.

Conversely, assume that the viewpoint moves, for example, from the portion that performs display of 33 gray scales to the portion that performs display of 32 gray scales, as indicated by the solid line. For a case where the viewpoint is at the portion that displays 33 gray scales when the pixels are in a turned-on state, and the viewpoint is at the portion that displays 32 gray scales when the pixels are in a turned-on state, the pixels seem to be turned on continuously during the one frame period by the human eye.

Therefore, the viewpoint moves slightly left and right, up and down, and consequently, the human eye perceives this as if the pixels are continuously turned on, or the pixels are continuously turned off, throughout the one frame period. The display disturbance is viewed as if the boundary portion fluctuates.

MEANS FOR SOLVING THE PROBLEMS

In order to prevent the above-mentioned false contours, the present invention is characterized roughly by having the following three structures.

According to a first structure of the present invention, there is provided a method of driving a light emitting device in which a plurality of pixels having a light emitting element represented by an OLED are formed, characterized by including: setting j display periods (where j is a natural number) to appear in one frame period, each of the j display periods corresponding to one bit of a k-bit digital video signal (where k is a natural number); and subjecting lower n bits of the k bits (where n is a natural number, $j \geqq k-n$) to one or both of dither processing and error diffusion processing to thereby select whether the pixels turn on or turn off in each of the j display periods according to a (k−n)-bit digital video signal that is converted from the k-bit digital video signal.

According to a second structure of the present invention, there is provided a method of driving a light emitting device in which a plurality of pixels having a light emitting element represented by an OLED are formed, characterized by including: setting j display periods (where j is a natural number) to appear in one frame period, each of the j display periods corresponding to one of q gray scale information (where q is a natural number); and turning on the pixels that perform display of the q-th gray scale information for at least one display period in addition to all of the turn-on display periods for displaying the (q−1)-th gray scale information.

According to a third structure of the present invention, there is provided a method of driving a light emitting device in which a plurality of pixels having a light emitting element represented by an OLED are formed, characterized by including: setting j display periods (where j is a natural number) to appear in one frame period; subjecting lower n bits of a k-bit digital video signal (where n is a natural number, $j \geqq k-n$) to one or both of dither processing and error diffusion processing to thereby select whether the pixels turn on or turn off in each of the j display periods according to a (k−n)-bit digital video signal that is converted from the k-bit digital video signal; causing each of the j display periods to correspond to one of q gray scale information included in the (k−n) bit digital video signal (where q is a natural number); and turning on the pixels that perform display of the q-th gray scale information for at least one display period in addition to all of the turn-on display periods for displaying the (q−1)-th gray scale information.

According to the present invention having the aforementioned first to third structures, the gray scale number which had only been adjusted in the time axis direction can be diffused in the spatial direction by using dither processing and error diffusion processing. Multiple gray scale display can thus also be assured, which may be difficult to achieve by adjustments only in the time axis direction.

Further, the present invention having the aforementioned second or third structure can employ a technique for expressing gray scales in which the number of display periods for turn-on is increased as the gray scale information becomes greater. By using this technique, display periods during which information for a second and subsequent gray scales are expressed will always immediately follow a display period during which the pixel is in a turn-on state. That is, a situation does not develop in which a display period that serves as a turn-on period upon expression of q-th gray scale information becomes a turn-off period during expression of (q−1)-th gray scale information. Accordingly, generation of false contours can be prevented.

Further, the ratio of the lengths of j display periods can be set to be non-linear. For example, there are cases in which γ-correction may be implemented on the lengths of the j display periods, thus setting the ratio of the lengths of the display periods to $1^{\gamma}:2^{\gamma}-1^{\gamma}:3^{\gamma}-2^{\gamma}: \ldots :j\gamma-(j-1)^{\gamma}$. In this case, gray scale expression that responds to the human visual characteristics can be achieved with good efficiency.

Note that the term signal gray scale information in the present invention corresponds to information that expresses an n-th gray scale (where n is a natural number) from among a 1st gray scale to the highest gray scale. Further, the term gray scale number corresponds to the total number of gray scale information, from the first gray scale to the highest gray scale, that a light emitting device is capable of expressing.

EMBODIMENT MODES OF THE INVENTION

Embodiment Mode 1

A structure of a light emitting device of the present invention and operation of the light emitting device are explained in this embodiment mode using FIG. 1 to FIG. 3.

The structure of the light emitting device is explained first using FIG. 1. The light emitting device has a pixel portion 102 in which (x*y) pixels 101 are arranged in a matrix shape on a substrate 107.

A signal line driver circuit 103, a first scanning line driver circuit 104, and a second scanning line driver circuit 105 are provided in the periphery of the pixel portion 102. Signals from the outside are supplied to the signal line driver circuit 103, and to the first and the second scanning line driver circuits 104 and 105, through an FPC 106. Note that the signal line driver circuit 103, and the first and the second scanning line driver circuits 104 and 105 may also be disposed in a portion outside the substrate 107 on which the pixel portion 102 is formed. Further, although one signal line driver circuit and two scanning line driver circuits are formed in FIG. 1, there are no particular limitations placed on the number of each of the circuits. The numbers of these circuits used depends on the structure of the pixel 101, and can be arbitrarily set.

Note that light emitting panels, in which a pixel portion having light emitting elements and a driver circuit are enclosed between a substrate and a cover, light emitting modules in which an IC or the like is mounted in the light emitting panel, light emitting displays used as display devices, and the like are all contained in the category of light emitting devices in the present invention. That is, the term light emitting device corresponds to a generic name for the light emitting panels, the light emitting modules, the light emitting displays, and the like.

The signal line driver circuit 103 is connected to an A/D converter circuit 11, a data separator circuit 12, an image processing circuit 13, and a time division signal generator circuit 16. Note that the A/D converter circuit 11, the data separator circuit 12, the image processing circuit 13, and the time division signal generator circuit 16 may also be formed integrally on the substrate 107, on which the pixel portion 102 is formed.

The A/D converter circuit 11 samples an analog video signal input from the outside, converts this to a k-bit digital video signal (where k is a natural number) for each pixel, and supplies the digital video signal to the data separator circuit 12.

The data separator circuit 12 separates the k-bit digital video signal as (k−n) bits of data (upper (k−n) bits) and n bits of data (lower n bits). The upper (k−n) bits are supplied to the time division signal generator circuit 16, and the lower n bits are supplied to the image processing circuit 13.

The image processing circuit 13 has a dither circuit 15 and an error diffusion circuit 14, and performs one or both of dither processing and error diffusion processing on the lower n bits of the data. The n-bit digital video signal that is converted from the k-bit digital video signal through the aforementioned processing is then supplied to the time division signal generator circuit 16. The n-bit digital video signal is then converted into a signal suitable for a time gray scale method by the time division signal generator circuit 16. The converted signal is then supplied to the signal line driver circuit 103. Finally, the converted signal is supplied from the signal line driver circuit 103 to each of the pixels 101.

The structure and operation of the error diffusion circuit 14 of the image processing circuit 13 are explained here using FIG. 2. The error diffusion circuit 14 has a computing unit 21, a comparator 22, a computing unit 23, and an error filter 24.

Error diffusion processing performed in the error diffusion circuit 14 is a method in which errors caused in pixels, which have already been scanned and whose gray scale information is determined, are fed back for the determination of the gray scale information of the next pixel, making it possible to approximate an average density value over several pixels.

If the gray scale information is assumed to take on a value ranging from 0 to 1, then the square error is expected to become a minimum when the threshold value is 0.5. Assume that the gray scale information of the pixel at a location (i,j) is 0.7 in FIG. 2(B) when the pixel is scanned in the direction of a solid line arrow. However, the gray scale information of the pixel can only take on 0 or 1. The threshold value at this point is 0.5. Therefore a comparison is made in the comparator 22 between the value of the gray scale information and the threshold value. Since 0.7>0.5, the gray scale information of the pixel located at (i,j) is set to 1. This pixel information with a value of 1 is supplied to the time division signal generator circuit 16 and to the computing unit 23. Further, an error is calculated by the computing unit 23, and in this case the error becomes 0.7−1=0.3. Errors of this type are accumulated to be taken as an average error in the vicinity of the pixel of interest.

Assuming that the gray scale information of a next pixel located at (i+1, j) is 0.7, and this value and the value of the accumulated errors −0.3 are added by the computing unit 21 to realize a surface area ratio of 0.4, the sum of the two gray scale information becomes 1.4 and reproduction of a correct gray scale is achieved. Therefore the sum of the values of the gray scale information and the accumulated errors at that location, the sum being 0.4, is compared with the threshold value of 0.5 in the comparator 22. This time, since 0.4<0.5, the gray scale information of the pixel becomes zero. The value of the accumulated errors then becomes 0.4−0=+0.4. Thus, errors that are caused in pixels in which the gray scale information has been determined are thus propagated in determining the gray scale information of the next pixel.

In practice, however, continuing such error propagation endlessly is not a good idea in terms of oscillation of the pixel gray scale information, and the like. It is preferable to apply and use a filter at a value in the vicinity of a certain level.

Examples of error filters 24 often used are shown in FIGS. 2(C) and 2(D). FIG. 2(C) is a filter proposed by Floyd & Steinberg. Among pixels already being scanned, a weight is given to four pixels that are adjacent to a target pixel, and these pixels are used. FIG. 2(D) is a filter proposed by Jarvis, Judice, & Ninke. Among pixels already being scanned, a weight is given to 12 pixels that are adjacent to a target pixel, and these pixels are used. The errors do not accumulate endlessly with the aforementioned two methods. Weights like those of FIGS. 2(C) and 2(D) are given to only the pixels in the specified vicinity and errors of the pixels are computed and added to a value of the target pixel, after which the sum is compared with the threshold value and binarized.

Next, the structure and operation of the dither circuit 15 are explained here using FIG. 3. The dither circuit 15 has a computing unit 31 and a comparator 32.

Dither processing that is performed in the dither circuit 15 utilizes spatial frequency characteristics of vision. Therefore when the pixels in the vicinity are taken together and seen, brightness can be visually sensed in proportion to the number of the pixels that are emitting light, even in a binary image. There is a method in which light and dark display is achieved by binary display utilizing this method.

With dither processing, the gray scale information of the image desired to be displayed is compared with the threshold value, and a value of 1 or zero is determined according to the result of the comparison. For example, the pixel has gray scale information of 1 when a source image gray scale information x and a threshold value y satisfy $x \geqq y$, and the pixel has gray scale information of zero when $x<y$ is satisfied.

The threshold value y may be set to a fixed value, and a limited size threshold value image (dither matrix) may also be used. In order to be able to see an image, which is binarized by comparison with this threshold image, with the same spatial brightness as the original image, it is necessary that the threshold values be distributed throughout the light and dark values, without bias. FIG. 3(B) is a dot threshold value image, and FIG. 3(C) is a Bayer-type threshold image.

A case of performing dither processing using the threshold images shown in FIG. 3(C) is explained here using FIGS. 3(D) to 3(F).

First, lower n bits of the image data, which is supplied from the data separator circuit 12, is normalized to zero to 16 for every bit. A diagram showing gray scale information for that image data is shown in FIG. 3(D). Next, the source image (x,y) is converted into a binary image g(x,y) by using a threshold value image $D_{ij}$. In order to perform binarization, f(x,y) and the threshold value image $D_{ij}$ are compared, and 1 is set when f(x,y) is larger, while zero is set when f(x,y) is smaller. A binary image can be obtained by performing such process for f(x,y) over all of the pixels. When the 4×4 threshold value image of FIG. 3(C) is used, 17 levels of shading can be expressed, including a combination of 16 pixels and one state in which all of the pixels are turned off.

Note that computations relating to the pixel gray scale information include only comparisons when dither processing is used, enabling high speed processing. When expressing a binary image, the number of pixels that light up increases as x becomes larger, and the image becomes brighter.

Further, not only can one processing method be performed, i.e., error diffusion processing or dither processing, but both types of processing may also be performed. In that case, the error diffusion circuit 14 and the dither circuit 15 are connected as shown in FIG. 3(G) and both error diffusion processing and dither processing may be performed, supplying the result to the time division signal generator circuit 16.

Thus, in the present invention, data is separated into two, and the binary coding method is used along with one or both of dither processing and error diffusion processing. By doing so the gray scale number which had only been adjusted in the time axis direction can be diffused in the spatial direction by using dither processing and error diffusion processing. Accordingly, multiple gray scale display can be assured, which is otherwise difficult to be achieve by only adjusting the gray scale number in the time axis direction.

Embodiment Mode 2

Two typical structures are given in this embodiment mode for the pixel 101 that is disposed in an i-th column and a j-th row of the pixel portion 102, and explained using FIGS. 4(A) and 4(B). Further, operation of the pixel 101 is explained using FIG. 5.

The pixel 101 shown in FIG. 4(A) has a switching transistor 306, a driver transistor 307, and a light emitting element 308. The pixel 101 shown in FIG. 4(B) has the structure of the pixel 101 that is shown in FIG. 4(A), with the addition of an erasing transistor 309 and a scanning line $R_j$.

In FIGS. 4(A) and 4(B), a gate electrode of the switching transistor 306 is connected to a scanning line $G_j$, a first electrode of the switching transistor 306 is connected to a signal line $S_i$, and a second electrode of the switching transistor 306 is connected to a gate electrode of the driver transistor 307. A first electrode of the driver transistor 307 is connected to an electric power source line $V_i$, and a second electrode of the driver transistor 307 is connected to one electrode of the light emitting element 308. The other electrode of the light emitting element 308 is connected to an electric power source line $C_j$.

Further, in FIG. 4(B) the switching transistor 306 and the erasing transistor 309 are connected in series, and disposed between the signal line $S_i$ and the electric power source line $V_i$. A gate electrode of the erasing transistor 309 is connected to the scanning line $R_j$.

With the present invention, the one electrode of the light emitting element 308 that is connected to the second electrode of the driver transistor 307 is referred to as a pixel electrode, and the other electrode of the light emitting element 308, which is connected to the electric power source line Cj, is referred to as an opposing electrode.

In FIGS. 4(A) and 4(B), the switching transistor 306 has a function for controlling the input of signals into the pixel 101. It is sufficient for the switching transistor 306 to have a function as a switch, and therefore no limitations are placed on its conductivity type. Both n-channel and p-channel types can be used.

Further, in FIGS. 4(A) and 4(B), the driver transistor 307 has a function for controlling light emission of the light emitting element 308. There are no particular limitations placed on the conductivity type of the driver transistor 307, but when the driver transistor 307 is a p-channel transistor, the pixel electrode becomes the anode, and the opposing electrode becomes the cathode. Further, when the driver transistor 307 is an n-channel transistor, the pixel electrode becomes the cathode, and the opposing electrode becomes the anode.

In FIG. 4(B), the erasing transistor 309 has a function for stopping light emission of the light emitting element 308. It is sufficient for the erasing transistor 309 to have a function as a switch, and therefore there are no particular limitations placed on the conductivity type of the erasing transistor 309. A transistor having n-channel or p-channel type conductivity may be used.

In addition to a single gate structure with one gate electrode, the transistors disposed in the pixel 101 may also have a multi-gate structure such as a double gate structure in which there are two gate electrodes, or a triple gate structure in which there are three gate electrodes. Further, the transistors may also have a top gate structure, in which the gate electrode is disposed in an upper portion of a semiconductor, or a bottom gate structure, in which the gate electrode is disposed in a lower portion of the semiconductor.

Next, a timing chart of a time gray scale method of a binary coding method is explained using FIG. 5. Note that timing charts for the pixels 101 shown in FIGS. 4(A) and 4(B) differ, and therefore operation of the pixel 101 of FIG. 4(A) is explained using FIG. 5(A), and operation of the pixel 101 of FIG. 4(B) is explained using FIGS. 5(B) and 5(C). The timing charts shown in FIG. 5 show time on the horizontal axis, and the scanning line on the vertical axis. Further, a case of performing 5-bit display is explained here as an example.

With the time gray scale method, one frame period is divided into a plurality of subframe periods each denoted by SF. In FIG. 5(A), each of the subframe periods SF has an address period Ta and a display period Ts. In FIG. 5(B), each of the subframe periods SF has the address period Ta and the display period Ts, or the address period Ta, the display period Ts, and an erasing period Te.

The address period Ta is a period for writing in a digital video signal into each pixel, and the length of the address period Ta is equal in each of the subframe periods SF. The display period Ts is a period during which the light emitting elements perform light emission or do not perform light emission based on the video signal written into each of the pixels, thus determining whether the pixels turn on or turn off.

The erasing period Te is a period set when operating a pixel provided with the erasing transistor 309 as in the pixel 101 of FIG. 4(B). The erasing period Te is only set in each subframe period SF having a shorter display period Ts than the address period Ta. This is to prevent the next address period Ta from beginning immediately after the display period Ts is complete. If the address period Ta is assumed to begin immediately after the display period Ts is complete, then two scanning lines are selected at the same timing, and the signals will not be accurately input from the signal lines into the pixels.

With the time gray scale method, the lengths of turn on periods in each of the subframe periods SF differ. Gray scales are expressed by combining turn on and turn-off of pixels in each of the subframe periods SF. With the example shown in FIG. 5, the number of gray scales is 5-bit, and the one frame period is divided into five subframe periods SF1 to SF5. The lengths of display periods Ts1 to Ts5 in each of the subframe periods are set to second powers, becoming Ts1:Ts2:Ts3:Ts4:Ts5=16:8:4:2:1, and multiple gray scales are obtained. That is, when expressing n-bit gray scales, the ratio of the lengths of display periods Ts1 to Tsn becomes $2^{(n-1)}:2^{(n-2)}: \ldots :2^1:2^0$.

When performing k-bit display with the present invention, as discussed above in Embodiment Mode 1, the data is first separated into the upper (k−n) bits and the lower n bits. Then, one or both of dither processing and error diffusion processing are performed on lower n bits, and an image is displayed using the (k−n)-bit digital video signal converted from the k-bit digital video signal.

When performing 7-bit display, for example, the data is separated into upper five bits and lower two bits. Then, one or both of dither processing and error diffusion processing are performed on the lower two bits. An image is then displayed using a 5-bit digital video signal that is converted from the 7-bit digital video signal.

Operations of the pixel 101 of FIG. 4(A) in the address period Ta and in the display period Ts in FIG. 5(A) are explained here.

In the address period Ta, a pulse is input to the scanning line $G_j$, which becomes H level, and the switching transistor 306 turns on. Accordingly, the digital video signal output to the signal line $S_i$ is input to the gate electrode of the driver transistor 307.

In the display period Ts, electric current flows in the light emitting element 308 due to the electric potential difference between the electric potential of the electric power source line $V_i$ and the electric potential of the electric power source line $C_j$ caused by turning on the driver transistor 307, thereby emitting light. Further, electric current does not flow in the light emitting element 308 when the driver transistor 307 is off, the light emitting element 308 does not emit light, and the pixel is placed in a turned-off state.

In FIGS. 5(B) and 5(C), operation in the address period Ta and in the display period Ts is the same as that for the pixel 101 of FIG. 4(A), and therefore operation of the pixel 101 of FIG. 4(B) only during the erasing period Te is explained here.

In the erasing period Te, a pulse is input to the scanning line $R_j$, which becomes H level, and the erasing transistor 309 turns on. The voltage between the gate and the source of the driver transistor 307 becomes zero when the erasing transistor 309 turns on, and the driver transistor 307 thus turns off. Current thus ceases to flow in the light emitting element 308, and the pixel is placed in a turned-off state. Note that the erasing period Te is set only in the subframe period SF5. This is because the next address period will not begin immediately after the display period Ts5 is complete due to the display period Ts5 being shorter than the address period Ta5 in the subframe period SF5.

Note that although the subframe periods SF1 to SF5 appear in order in the timing chart shown in this embodiment mode, the present invention is not limited to this order. The subframe periods may also appear randomly.

Thus, in the present invention, data is separated into two and the binary coding method is used along with one or both of dither processing and error diffusion processing. By doing so, the gray scale number which had only been adjusted in the time axis direction can be diffused in the spatial direction by using dither processing and error diffusion processing. Accordingly, multiple gray scale display can be assured which is difficult to be achieved by only adjusting the gray scale number in the time axis direction.

Embodiment Mode 3

A structure of a light emitting device that differs from those of the aforementioned Embodiment Modes 1 and 2 is explained using FIG. 6(A) in this embodiment mode.

First, an outline of the light emitting device is explained. As shown in FIG. 6(A), the outline of the light emitting device is based on the structure of FIG. 1, but the signal driver circuit 103 in this embodiment is connected to the A/D converter circuit 11, the γ-correction circuit 18, and the time division signal generator circuit 16.

The A/D converter circuit 11 samples an analog video signal input from the outside, converts the sampled signal into a k-bit (where k is a natural number) digital video signal for each pixel, and supplies the converted signal to the γ-correction circuit 18.

The γ-correction circuit 18 has a function for performing γ-correction, and performs γ-correction on the video signal supplied from the A/D converter circuit 11 by using an arbitrary γ value. The γ-corrected video signal is then supplied to the time division signal generator circuit 16. The signal is next supplied from the time division signal generator circuit 16 to the signal line driver circuit 103, and lastly the signal is supplied from the signal line driver circuit 103 to each of the pixels.

Next, operation of the light emitting device having the structure described above is explained using a timing chart of FIG. 7. The timing chart shown in FIG. 7 shows time on the horizontal axis, and shows gray scale information on the vertical axis.

With the time gray scale method, one frame period is divided into a plurality of subframe periods each denoted by SF. Each of the subframe periods has an address period Ta and a display period Ts, or has the address period Ta, the display period Ts, and an erasing period Te. Detail of the address period and the like is omitted from FIG. 7.

In this embodiment mode, turn-on or turn-off on during each of the subframe periods is determined according to the gray scale information in each signal. As shown in FIG. 7, with a signal having a first gray scale information, pixels are turned on in SF1. With a signal having information on a second gray scale, pixels are turned on in SF1 and SF2. With a signal having a third gray scale information, pixels are turned on in SF1 to SF3. Turn-on or turn-off in each of the subframe periods is thus determined according to the gray scale information. With a signal having information for eighth gray scale, pixels are turned on in all of the periods SF12 to SF8. A total period of SF1 to SF8 corresponds to the one frame period in this embodiment mode.

To explain in a more general term, setting j display periods (where j is a natural number) in one frame period, each of the j display periods corresponds to one of q gray scale information (where q is a natural number); and the pixels that perform display of the q-th gray scale information for at least one display period in addition to all of the turn-on display periods for displaying the (q−1)-th gray scale information.

The length of a period for turn on differs in each of the subframe periods SF, and gray scales are expressed by combining turn-on and turn-off on of pixels in each of the subframe periods SF. With the example shown in FIG. 7, the number of gray scales is set to 8, and the one frame period is divided into eight subframe periods SF1 to SF8. The lengths of display periods Ts1 to Ts8 in each of the subframe periods are non-linear. For example, the lengths are set by performing γ-correction on second powers so that Ts1:Ts2:Ts3:Ts4:Ts5:Ts6:Ts7:Ts8$=1^{\gamma}:2^{\gamma}-1^{\gamma}:3^{\gamma}-2^{\gamma}:4^{\gamma}-3^{\gamma}:5^{\gamma}-4^{\gamma}:6^{\gamma}-5^{\gamma}:7^{\gamma}-6^{\gamma}:8^{\gamma}-7^{\gamma}$. That is, when expressing information for n gray scales, the ratio between the lengths of display periods Ts1 to Tsn becomes $1^{\gamma}:2^{\gamma}-1^{\gamma}:3^{\gamma}-2^{\gamma}: \ldots :j^{\gamma}-(j-1)^{\gamma}$.

The present invention having the aforementioned structure can employ a technique for expressing gray scales in which the number of display periods for turn-on is increased as the gray scale information becomes greater. By using this technique, display periods during which information for a second and subsequent gray scales are expressed will always immediately follow a display period during which the pixel is in a turned-on state. That is, a situation does not develop in which a display period that serves as a turn-on period upon expression of q-th gray scale information becomes a turn off period during expression of (q−1)-th gray scale information. Accordingly, generation of false contours can be prevented.

Further, the ratio of the lengths of j display periods can be set to be non-linear. For example, there are cases in which γ-correction may be implemented on the lengths of the j display periods, thus setting the ratio of the lengths of the display periods to $1^{\gamma}:2^{\gamma}-1^{\gamma}:3^{\gamma}-2^{\gamma}: \ldots :j^{\gamma}-(j-1)^{\gamma}$. In this case, gray scale expression that responds to the human visual characteristics can be achieved with good efficiency.

Note that although the one frame period is divided into 8 subframe periods here, matching the information for 8 gray scales, the present invention is not limited to this. The number of division of the one frame period can be arbitrarily set. Further, for cases where the one frame period is divided into 8 subframe periods, expression may be performed over two frame periods when expressing information for nine or more gray scales.

Embodiment Mode 4

A structure of a light emitting device that differs from those of the aforementioned Embodiment Modes 1 to 3 is explained using FIG. 6(B) in this embodiment mode.

First, an outline of the light emitting device is explained. Note that the outline of the light emitting device is based on the structure of FIG. 1, but the signal driver circuit 103 in this embodiment is connected to the A/D converter circuit 11, the γ-correction circuit 18, the data separation circuit 12, the image processing circuit 13, and the time division signal generator circuit 16.

The A/D converter circuit 11 samples an analog video signal input from the outside, converts the sampled signal into a k-bit (where k is a natural number) digital video signal for each pixel, and supplies the converted signal to the γ-correction circuit 18.

In the γ-correction circuit, γ-correction is performed on a video signal supplied from the A/D converter circuit 11 by using an arbitrary γ value. The γ corrected video signal is then supplied to the data separation circuit 12, and separated into (k−n) bits (upper (k−n) bits) and n bits (lower n bits). One or both of dither processing and error diffusion processing are performed on the lower n-bit signal in the signal processing circuit 13. A (k−n) bit digital video signal converted from the k-bit digital video signal is then supplied to the time division signal generator circuit 16.

The present invention having the aforementioned structures relates to a method of driving a light emitting device in which a plurality of pixels having a light emitting element are formed, characterized by including:

expressing j display periods (where j is a natural number) in one frame period;

subjecting lower n bits of a k-bit digital video signal (where n is a natural number, $j \geqq k-n$) to one or both of dither processing and error diffusion processing to thereby select whether the pixels turn on or turn off in each of the j display periods according to a (k−n)-bit digital video signal that is converted from the k-bit digital video signal;

causing each of the j display periods to correspond to one of q gray scale information included in a (k−n)-bit digital video signal (where q is a natural number); and turning on the pixels that perform display of the q-th gray scale information for at least one display period in addition to all of the turn-on display periods for displaying the (q−1)-th gray scale information.

According to the present invention having the aforementioned structure, the gray scale number which had only been adjusted in the time axis direction can be diffused in the spatial direction by using dither processing and error diffusion processing. Accordingly, multiple gray scale display can be assured, which is otherwise difficult to be achieved by only adjusting the gray scale number in the time axis direction.

Further, the present invention having the aforementioned structure can employ a technique for expressing gray scales in which the number of display periods for turn-on is increased as the gray scale information becomes greater. By using this technique, display periods during which information for a second and subsequent gray scales are expressed will always immediately follow a display period during which the pixel is in a turned-on state. That is, a situation does not develop in which a display period that serves as a turn-on period upon expression of q-th gray scale information becomes a turn off period during expression of (q−1)-th gray scale information. Accordingly, generation of false contours can be prevented.

Further, the ratio of the lengths of j display periods can be set to be non-linear. For example, there are cases in which γ-correction may be implemented on the lengths of the j display periods, thus setting the ratio of the lengths of the display periods to $1^{\gamma}:2^{\gamma}-1^{\gamma}:3^{\gamma}-2^{\gamma}:\ldots:j^{\gamma}-(j-1)^{\gamma}$. In this case, gray scale expression that responds to the human visual characteristics can be achieved with good efficiency.

Embodiment Mode 5

Structures and operation of the signal driver circuit 103, the first scanning line driver circuit 104, and the second scanning line driver circuit 105 are explained in this embodiment using FIG. 8.

First, the signal line driver circuit 103 is explained using FIG. 8(A). The signal line driver circuit 103 has a shift register 311, a first latch circuit 312, and a second latch circuit 313.

Operation of the signal line driver circuit 103 is explained here in brief. The shift register 311 is structured by using a plurality of columns of flip-flow circuits (FF) or the like. A clock signal (S-CLK), a start pulse (S-SP), and a clock inverted signal (S-CLKb) are input to the shift register 311. Sampling pulses are output one after another in accordance with the timing of these signals.

The sampling pulses that are output by the shift register 311 are input to the first latch circuit 312. A digital video signal is input to the first latch circuit 312, and the video signal is stored by each of the columns in accordance with the timing at which the sampling pulses are input.

When storage of the video signal is complete in the first latch circuit 312 up through the final column, a latch pulse is input to the second latch circuit 313 during a horizontal return period. The video signal that is stored in the first latch circuit 312 is then transferred all at once to the second latch circuit 313. Then, the video signal for one row stored in the second latch circuit 313 is input to signal lines $S_1$ to $S_x$ simultaneously.

While the video signal stored in the second latch circuit 313 is being input to the signal lines S1 to Sx, sampling pulses are again output from the shift register 311. These operations are then subsequently repeated.

The first scanning line driver circuit 104 and the second scanning line driver circuit 105 are explained next using FIG. 8(B). Each of the scanning line driver circuits has a shift register 314 and a buffer 315. To explain the operation in brief, the shift register 314 outputs sampling pulses one after another in accordance with a clock signal (G-CLK), a start pulse (G-SP), and a clock inverted signal (G-CLKb). The sampling pulses are then amplified by the buffer 315, and input to the scanning lines. One row at a time is thus placed in a selected state. The digital video signal is then written from the scanning lines $S_1$ to $S_x$ in order to the pixels, which are controlled by the respective scanning lines that are selected.

Note that a structure may also be used in which a level shifter circuit is disposed between the shift register 314 and the buffer 315. Disposing the level shifter circuit between the shift register 314 and the buffer 315 can thus change the voltage amplitude of a logic circuit portion and a buffer portion.

It is possible to arbitrarily combine this embodiment mode with Embodiment Modes 1 to 4.

Embodiment Mode 6

Electronics of the present invention includes, for example, video cameras, digital cameras, goggle type displays (head mount displays), navigation systems, audio reproducing devices (such as car audio and audio components etc.), laptops, game machines, mobile information terminals (such as mobile computers, cellular phones, portable game machines, and electronic books etc.), and image reproducing devices provided with a recording medium (specifically, devices for reproducing a recording medium such as a Digital Versatile Disc (DVD), which includes a display capable of displaying images). Practical examples of these electronics are shown in FIG. 9.

FIG. 9(A) shows a light emitting device, which contains a casing 2001, a support base 2002, a display portion 2003, a speaker portion 2004, a video input terminal 2005, and the like. The present invention can be applied to the display portion 2003. Since the light emitting device is of a self-luminous type, it does not need a back light, and therefore a display portion that is thinner than that of a liquid crystal display can be obtained. Note that light emitting devices include all information display devices, for example, personal computers, television broadcast transmitter-receivers, advertisement displays and the like.

FIG. 9(B) shows a digital still camera, which contains a main body 2101, a display portion 2102, an image receiving portion 2103, operation keys 2104, an external connection port 2105, a shutter 2106, and the like. The present invention can be applied to the display portion 2102.

FIG. 9(C) shows a note type personal computer, which contains a main body 2201, a casing 2202, a display portion 2203, a keyboard 2204, external connection ports 2205, a pointing mouse 2206, and the like. The present invention can be applied to the display portion 2203.

FIG. 9(D) shows a mobile computer, which contains a main body 2301, a display portion 2302, a switch 2303, operation keys 2304, an infrared port 2305, and the like. The present invention can be applied to the display portion 2302.

FIG. 9(E) shows a portable image reproducing device provided with a recording medium (specifically, a DVD reproducing device), which contains a main body 2401, a casing 2402, a display portion A 2403, a display portion B 2404, a recording medium (such as a DVD) read-in portion 2405, operation keys 2406, a speaker portion 2407, and the like. The display portion A 2403 mainly displays image information, and the display portion B 2404 mainly displays character information. The present invention can be used in the display portion A 2403 and in the display portion B 2404. Note that domestic game machines and the like are included in the image reproducing devices provided with a recording medium.

FIG. 9(F) shows a goggle type display (head mounted display), which contains a main body 2501, a display portion 2502 and an arm portion 2503. The present invention can be used in the display portion 2502.

FIG. 9(G) shows a video camera, which contains a main body 2601, a display portion 2602, a casing 2603, external connection ports 2604, a remote control reception portion 2605, an image receiving portion 2606, a battery 2607, an audio input portion 2608, operation keys 2609, an eyepiece portion 2610, and the like. The present invention can be used in the display portion 2602.

Here, FIG. 9(H) shows a cellular phone, which contains a main body 2701, a casing 2702, a display portion 2703, an audio input portion 2704, an audio output portion 2705, operation keys 2706, external connection ports 2707, an antenna 2708, and the like. The present invention can be used in the display portion 2703. Note that, by displaying white characters on a black background, the current consumption of the cellular phone can be suppressed.

When the emission luminance of light emitting materials are increased in the future, the light emitting device will be able to be applied to a front or a rear type projector by expanding and projecting light containing image information having been output lenses or the like.

Cases are increasing in which the above-described electronics displays information distributed via electronic communication lines such as the Internet and CATVs (cable TVs). Particularly increased are cases which moving picture information is displayed. Since the response speed of the light emitting materials is very high, the light emitting device is preferably used for moving picture display.

Since the light emitting device consumes power in a light emitting portion, information is desirably displayed so that the light emitting portions are reduced as much as possible. Thus, in the case where the light emitting device is used for a display portion of a mobile information terminal, particularly, a cellular phone, an audio reproducing device, or the like, which primarily displays character information, it is preferable that the character information be formed in the light emitting portions with the non-light emitting portions being used as the background.

As described above, the application range of the present invention is very wide, so that the present invention can be used for electronics in all of fields. The electronics according to this embodiment mode may use the structure of the signal line driving circuit according to any one of Embodiment Modes 1 to 5.

EFFECTS OF THE INVENTION

According to the present invention having the aforementioned structures, the gray scale number which had only been adjusted in the time axis direction can be diffused in the spatial direction by using dither processing and error diffusion processing. Accordingly, multiple gray scale display can be assured, which is otherwise difficult to be achieved by only adjusting the gray scale number in the time axis direction.

Further, the present invention having the aforementioned structure can employ a technique for expressing gray scales in which the number of display periods for turn-on is increased as the gray scale information becomes greater. By using this technique, display periods during which information for a second and subsequent gray scales are expressed will always immediately follow a display period during which the pixel is in a turned-on state. That is, a situation does not develop in which a display period that serves as a turn-on period upon expression of q-th gray scale information becomes a turn off period during expression of (q−1)-th gray scale information. Accordingly, generation of false contours can be prevented.

Further, the ratio of the lengths of j display periods can be set to be non-linear. For example, there are cases in which γ-correction may be implemented on the lengths of the j display periods, thus setting the ratio of the lengths of the display periods to $1^{\gamma}:2^{\gamma}-1^{\gamma}:3^{\gamma}-2^{\gamma}:\ldots:j^{\gamma}-(j-1)^{\gamma}$. In this case, gray scale expression that responds to the human visual characteristics can be achieved with good efficiency.

The invention claimed is:

1. A method of driving a light emitting device in which a plurality of pixels having a light emitting element are formed, the method comprising:

setting j display periods (where j is a natural number) in one frame period, each of the j display periods corresponding to one bit of a k-bit digital video signal (where k is a natural number);

subjecting lower n bits of the k bits (where n is a natural number, $j \geqq k-n$) to one or both of dither processing and error diffusion processing to thereby select whether the pixels turn on or turn off in each of the j display periods according to a (k−n)-bit digital video signal that is converted from the k-bit digital video signal; and turning on the pixels that perform display of the q-th gray scale information for at least one display period in addition to all of the turn-on display periods for displaying the (q−1)-th gray scale information (where q is a natural number).

2. A method of driving a light emitting device in which a plurality of pixels having a light emitting element are formed, the method comprising:

setting j display periods (where j is a natural number) in one frame period;

subjecting lower n bits of a k-bit digital video signal (where n is a natural number, $j \geqq k-n$) to one or both of dither processing and error diffusion processing to thereby select whether the pixels turn on or turn off in each of the j display periods according to a (k−n)-bit digital video signal that is converted from the k-bit digital video signal;

causing each of the j display periods to correspond to one of q gray scale information included in a (k−n)-bit digital video signal (where q is a natural number); and turning on the pixels that perform display of the q-th gray scale information for at least one display period in addition to all of the turn-on display periods for displaying the (q−1)-th gray scale information.

3. A method of driving a light emitting device according to claim 1, wherein a ratio of lengths of the j display periods becomes $2^{(j-1)}:2^{(j-2)}:\ldots:2^1:2^0$, in sequence from upper bits.

4. A method of driving a light emitting device according to any one of claims 1 and 2, wherein a ratio of lengths of the j display periods is a non-linear ratio.

5. A method of driving a light emitting device according to any one of claims 1 and 2, wherein a ratio of lengths of the j display periods becomes $1^\gamma:2^\gamma-1^\gamma:3^\gamma-2^\gamma:\ldots:j^\gamma-(j-1)^\gamma$ (where γ is an arbitrary value).

6. A light emitting device comprising:

a plurality of pixels each having a light emitting element and a thin film transistor:

a signal line driver circuit;

a scanning line driver circuit; and an image processing circuit having at least one of an error diffusion circuit and a dither circuit, wherein the image processing circuit is adapted to:

set j display periods (where j is a natural number) in one frame period;

subject lower n bits of a k-bit digital video signal (where n is a natural number, $j \geqq (k-n)$ to one or both of the error diffusion circuit and the dither circuit to thereby select whether the pixels turn on or turn off in each of the j display periods according to a (k−n)-bit digital video signal that is converted from the k-bit digital video signal;

wherein the plurality of pixels is adapted to perform display of q-th gray scale information and is turned on for at least one display period in addition to all of turn-on display periods for displaying (q−1)-th gray scale information (where q is a natural number).

7. A light emitting device according to claim 6, wherein the light emitting device is mounted in at least one of a digital camera, a personal computer, a mobile computer, an image reproducing device, a goggle display, a video camera, and a portable telephone.

8. A method of driving a light emitting device in which a plurality of pixels having a light emitting element are formed, the method comprising:

setting j display periods (where j is a natural number) in one frame period;

subjecting lower n bits of a k-bit digital video signal (where n is a natural number, $j \geqq k-n$) to one or both of dither processing and error diffusion processing to thereby select whether the pixels turn on or turn off in each of the j display periods according to a (k−n)-bit digital video signal that is converted from the k-bit digital video signal; and turning on the pixels that perform display of the q-th gray scale information for at least one display period in addition to all of the turn-on display periods for displaying the (q−1)-th gray scale information (where q is a natural number).

9. A method of driving a light emitting device according to claim 8, wherein a ratio of lengths of the j display periods is a non-linear ratio.

10. A method of driving a light emitting device according to claim 8, wherein a ratio of lengths of the j display periods becomes $1^\gamma:2^\gamma-1^\gamma:3^\gamma-2^\gamma:\ldots:j^\gamma-(j-1)^\gamma$ (where γ is an arbitrary value).

11. A light emitting device comprising:

a plurality of pixels each having a light emitting element and a thin film transistor;

a signal line driver circuit;

a scanning line driver circuit; and an image processing circuit having at least one of an error diffusion circuit and a dither circuit;

wherein the image processing circuit is adapted to:

set j display periods (where j is a natural number) in one frame period;

subject lower n bits of a k-bit digital video signal (where n is a natural number, $j \geqq k-n$) to one or both of the error diffusion circuit and the dither circuit to thereby select whether the pixels turn on or turn off in each of the j display periods according to a (k−n)-bit digital video signal that is converted from the k-bit digital video signal; and cause each of the j display periods to correspond to one of q gray scale information included in a (k−n)-bit digital video signal (where q is a natural number); and wherein the plurality of pixels is adapted to perform display of q-th gray scale information and is turned on for at least one display period in addition to all of turn-on display periods for displaying (q−1)-th gray scale information (where q is a natural number).

12. A light emitting device according to claim 11, wherein the light emitting device is mounted in at least one of a digital camera, a personal computer, a mobile computer, an image reproducing device, a goggle display, a video camera, and a portable telephone.

* * * * *